United States Patent [19]

Wick et al.

[11] 4,057,344

[45] Nov. 8, 1977

[54] ELECTRO-PHOTOGRAPHIC COPIER WITH STRIP-SHAPED LATENT-IMAGE CARRIER

[75] Inventors: Richard Wick, Munich; Josef Pfeifer, Unterhaching; Günther Schnall, Eching, all of Germany

[73] Assignee: AGFA-Gevaert Aktiengesellschaft, Leverkusen, Germany

[21] Appl. No.: 669,295

[22] Filed: Mar. 22, 1976

[30] Foreign Application Priority Data

Mar. 27, 1975 Germany ..... 2513825

[51] Int. Cl.[2] ..... G03G 15/00

[52] U.S. Cl. ..... 355/16; 242/67.3 R

[58] Field of Search ..... 355/16, 3 BE; 242/67.3 R, 64

[56] References Cited

U.S. PATENT DOCUMENTS

| | | | |
|---|---|---|---|
| 3,563,734 | 2/1971 | Shely | 355/16 X |
| 3,843,252 | 10/1974 | Tanaka et al. | 355/16 |
| 3,877,806 | 4/1975 | Schrempp et al. | 355/16 |

*Primary Examiner*—Richard L. Moses
*Attorney, Agent, or Firm*—Michael J. Striker

[57] ABSTRACT

An electro-photographic copier has a strip-shaped latent-image carrier which is payed out from a supply and taken up by a take-up. An image-forming station is provided at which an image of an original to be copied is formed on the image carrier, and a guide arrangement guides the image carrier on its way from the pay-out to the take-up in a path including at least adjacent the image-forming station a planar portion in which successive image-receiving increments of the image carrier travel past the station in substantially planar condition.

9 Claims, 4 Drawing Figures

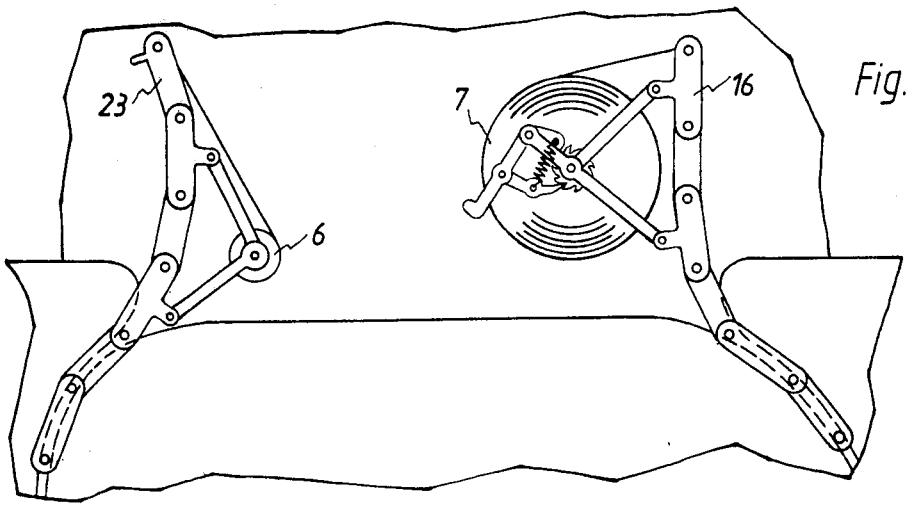
Fig.2
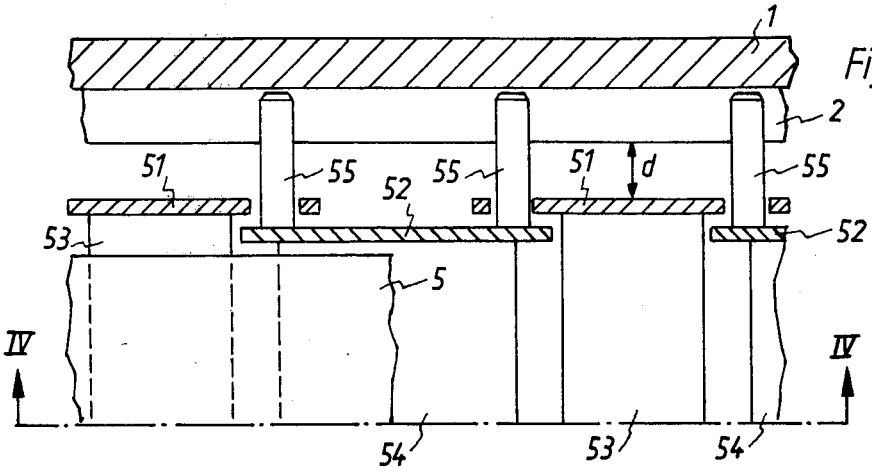
Fig.3
Fig.4
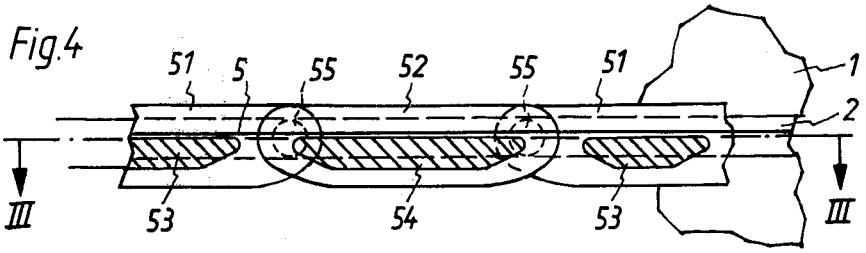

ELECTRO-PHOTOGRAPHIC COPIER WITH STRIP-SHAPED LATENT-IMAGE CARRIER

BACKGROUND OF THE INVENTION

The present invention relates to an electrophotographic copier in general, and more particularly to an electro-photographic copier of the type having a flexible strip-shaped latent-image carrier.

Electro-photographic copiers are known in the art which are of the type having an endless strip-shaped latent-image carrier that is trained about a plurality of rollers so that it travels in an endless path. The path has a portion in which the image carrier travels in planar condition past an image-forming station at which an image of an original to be copied is formed on the carrier. This type of copier requires that the latent-image carrier travel at a relatively high rate of speed and has to have rather complicated arrangements which prevent the carrier from slipping off the axial ends of the rollers about which it travels. These arrangements must necessarily be complicated because it is not merely sufficient to prevent such slipping-off, but it is also necessary to prevent the occurrence of damage to the readily damaged edge portions of the carrier.

Another copier of the type in question has a rotatable drum the periphery of which carries flexible photoconductive plates which engage the drum surface and are erected to a planar condition in the region of the image-forming station. These plates, as indeed the strip-shaped latent-image carrier of the first-mentioned copier, must be relatively frequently replaced because the relatively small quantities of photoconductive material on the carrier and the plates, respectively, means that the conductive material becomes spent rather quickly.

Another type of prior-art copier uses a strip-shaped latent-image carrier, i.e. a photoconductive carrier, which is pulled over a rotary body which is generally cylindrical and has a flat part. In this type of device it is necessary that—independently of the degree of wear of the photoconductive material on a particular increment of the carrier—the exposed increment of carrier must after each exposure be advanced from the flat part of the cylindrical body to the cylindrical part thereof, so that for each exposure a new carrier increment must be employed. This of course results in a very high rate of use of photoconductive material.

The prior art devices are, therefore, definitely in need of further improvements as the above brief description shows.

SUMMARY OF THE INVENTION

It is, accordingly, a general object of this invention to overcome the disadvantages of the prior art and to provide such improvements.

More particularly, it is an object of the present invention to provide an improved electro-photographic copier which is not possessed of those disadvantages.

Still more particularly it is an object of the invention to provide such an improved electro-photographic copier wherein the original to be copied can be flash-illuminated, rather than illuminating it in form of successive strips, so that the production of a copy of the original is considerably speeded up.

Still another object of the invention is to provide such a copier wherein the strip-shaped image carrier can be advanced incrementally whenever desired, i.e., after a desired number of copies has been produced with its aid.

In keeping with these objects, and with others which will become apparent hereafter, one feature of the invention resides, in an electro-photographic copier, in a combination which, briefly stated, comprises pay-out means for paying out a convoluted strip-shaped latent-image carrier, take-up means for taking up said carrier as the same is withdrawn from said pay-out means, and an image-forming station for forming an image of an original to be copied on the image-carrier. In addition, the combination comprises guide means for guiding the image carrier from the pay-out means to the take-up means in a path including at least adjacent the station a planar path portion in which successive image-receiving increments of the carrier travel past the station in substantially planar condition.

It is currently particularly preferred that the guide means comprise a guide arrangement in form of an articulated chain wherein the chain elements somewhat overlap one another essentially in the manner of a venetian blind. The lateral edge portions of this chain, which is endless, are guided in grooves provided for this purpose. The chain and also the latent-image carrier can travel in a path having any desired configuration but of course which is endless. The radius of curvature of any portion of the path can be accommodated in an optimum manner to the particular requirements of a specific application. An increment of the carrier which has been exposed can be re-exposed for any desired number of exposures, and after the photoconductive material of the carrier has become spent to a certain extent, or alternately, after a certain number of pre-selectable exposures has been made, the carrier is advanced from the payout to the take-up by a distance corresponding the previously used increment, thus exposing a new increment for use. At all other times the carrier rests upon and travels with the advancing chain.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a fragmentary section through the copier of FIG. 1, showing in detail the operation when the latent-image carrier is to be exchanged for a new one;

FIG. 3 is a fragmentary section through the articulated chain of FIGS. 1 and 2, taken on line III—III of FIG. 4; and FIG. 4 is a section taken on line IV—IV of FIG. 3.

DESCRIPTION OF A PREFERRED EMBODIMENT

Figure 1:
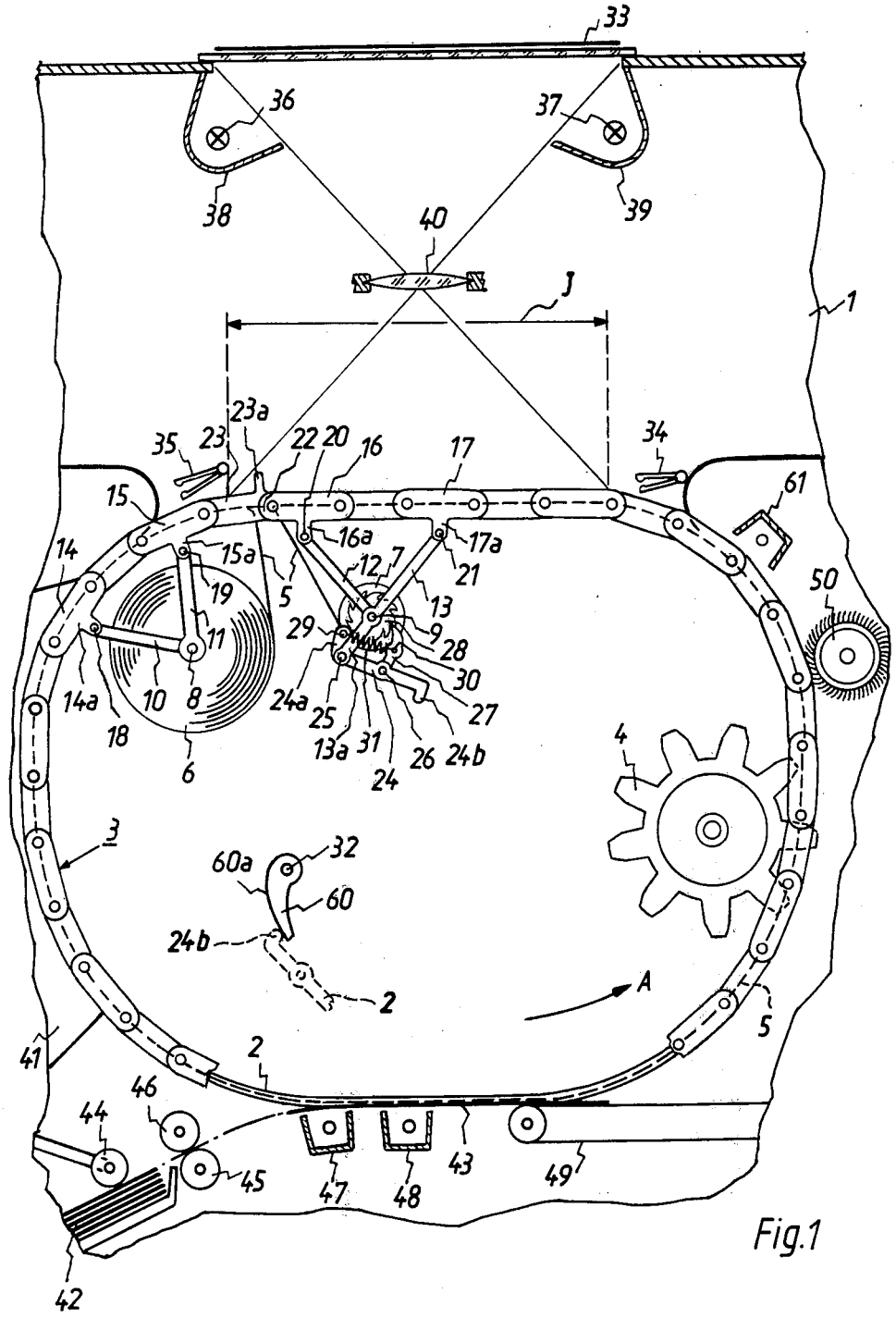
FIG. 1 is a fragmentary somewhat diagrammatic section through an electro-photographic copier embodying the invention.

FIGS. 1–4 illustrate a single exemplary embodiment of the invention. Only those parts of an electrophotographic copier embodying the invention have been shown, which are necessary for an understanding of the invention. Such copiers are well known and those parts of the copier which have not been described or illustrated in detail can be parts conventionally known in the prior art for such copiers.

With the above in mind it will be seen that reference numeral 1 identifies a frame, housing or the like of the electro-photographic copier which is formed with two endless grooves 2 (only one shown) in which an articulated-link supporting chain 3 travels, being guided for movement in these grooves in the manner to be discussed subsequently. The chain 3 is advanced in the direction of the arrow A by a drive gear 4 which is driven in rotation by a suitable drive, for example an electric motor which is not illustrated because it is known per se. An elongated strip-shaped latent-image carrier 5, i.e., a photoconductive band as described in the U.S. Pat. No. 3,826,570, is supported by and extends along the chain 3, as indicated in dashed lines in FIG. 1. A pay-out roller 6 is provided which carries a convoluted supply of the image carrier 5, and the carrier 5 can be incrementally withdrawn from the pay-out roller 6 and taken up in the same manner upon a take-up roller 7. The rollers 6 and 7 are journalled for rotation about respective shafts 8 and 9. The shaft 8 and the shaft 9 are mounted by means of arms or braces 10–13 on lugs **14*a*–17*a* of respective links 14–17 of the chain 3. The pairs of braces 10–13 are journalled to be pivotable about the shafts 8 and 9 as well as shafts 18–21, respectively. The carrier 5 travels from the pay-out roller 6 to the take-up roller 7 by passing along the chain 3 as indicated in broken lines in FIG. 1, for which purpose a slot 22 is formed between the links 16 and 23 of the chain 3, through which the carrier 5** travels.

As mentioned before, the carrier 5 is incrementally advanced from the pay-out roller 6 to the take-up roller 7. This incremental advancement is effected by means of a ratchet and pawl arrangement that is clearly shown in FIG. 1. An arm **13*a* of the brace 13 has journalled on it, pivotable about an axis 25, an angled lever 24 which carries a pin 26. A pawl 27 is pivotably mounted on the pin 26 and engages a gear 28 which is fixedly connected (for rotation) with the take-up roller 7. An abutment pin 29 is provided on the arm 24*a* of the angled lever 24 and a spring 31 has one of its ends connected to the pin 29 and another end connected to an eyelet, hook or other projection 30 of the pawl 27. Thus, the spring 31 urges the pawl 27 against the gear 28 and also urges a projection 24*b* of the lever 24 in the direction of the center of the space surrounded by the chain 3, until the pin 29 engages the arm 13*a*. Thus, each complete revolution of the chain 3 causes the projection 24*b* to engage a cam 60*a* which is formed on a lever 60 that is pivotally mounted on a shaft 32. This engagement causes the lever 24 to pivot about the axie 25, thus permitting the pawl 27 to advance the gear 28 and thus turn the take-up roller 7 and advance the carrier 5 by one increment. By turning the shaft 32 on which the lever 60 is mounted, the lever 60 itself can be changed as to its position and thus the position of the cam track 60*a* can be changed, whereby the travel of the projection 24*b* is influenced and the length of the increment of carrier 5 that can be advanced, is varied. Since the shaft 32 can be readily made accessible from exteriorly of the copier, the speed of incremental advancement of the carrier 5**—i.e. the frequency at which the incremental advancement takes place—can be adjusted from the exterior of the copier.

The operation of electro-photograhic copiers of the type in question is already known and will therefore only be briefly summarized. As the carrier 5 travels in a planar condition past the image-forming station, having been positioned in a planar condition by the fact that below the image-forming station the chain 3 travels in a planar path portion, a flash-illumination of the original 33 which is supported on a suitably transparent support of the copier, is effected. In fact, such a flash-illumination of the entire area of the original 33 is only possible due to the fact that the increment of the image carrier 5 which is being used at any given time (see the dimension I in FIG. 1) is located in a planar position oposite the image-forming station. Since in the region of the slot 22 no part of the image carrier 5 is available on the chain 3, it is neccessary to assure that no reproduction of the original 33 takes place while the slot 22 is within the range identified by the character I. This is achieved in a simple but efficacious manner by providing the link 23 with a projection **23*a* which momentarily closes an electrical contact 34 as the link 23 is about to enter into the area identified by the character I and in that the projection 23*a* momentarily closes a further electrical contact 35 as the link 23 leaves the area designated by the character I. Bistable circuits which are well known per se in the art, e.g., a flipflop, are utilized which, after momentary closing of the contact 34 prevent illumination of the original 33 until momentary closing of the contact 35** takes place. Thereafter, illumination can occur at any desired time.

A further consideration to be taken into account is the fact that no incremental advancement of the image carrier 5 must take place at such time at which at the transfer station a transfer of the image from the carrier 5 to a copy sheet 43 takes place. In the illustrated embodiment this is assured in that the lever 60 with the cam surface **60*a* is so positioned that the advancing mechanism for the image carrier 5 is actuated only when the slot 22 is in the region of the image transfer station. There is no transfer of images at the station at this time, i.e., when the slot is located in the region of the transfer station, because no image is formed on the image carrier 5 in the vicinity of the slot 22, there being no image carrier portion that overlies the slot 22** so that of necessity no image can be formed and consequently no image can later be transferred.

As FIG. 1 shows, the image-forming station includes flash lamps 36 and 37, reflectors 38 and 39 for the flash lamps, and a reproducing lens or lens system 40 which reproduces an image of the illuminated original 33 onto that portion of the carrier 5 which is located within the range I.

Following the image-forming station in the direction of travel of the chain 3 and the carrier 5, as indicated by the arrow A, are the conventional stations of an electrophotographic copier. This includes the developing station 41, a supply 42 of a stack of individual copy sheets 43, a feed roller 44 for the copy sheets 43, pairs of transport rollers 45 and 46 for the copy sheets 43, a transfer corona device 47, a removal corona device 48 which causes a charge tending to pull the copy sheet 43 away from the carrier 5, a transporter or conveyor belt 49, a cleaning device 50 which cleans the surface of the carrier 5, and a charging corona device 61 for uniform charging of the image carrier 5. All of these stations, their construction and function, are well known per se in the art and do not form a part of the invention, for which reason they are not described in detail.

As FIGS. 3 and 4 show more clearly, the opposite lateral edges (only one shown) of the chain 3 are guided in respective guide grooves 2 formed in walls or other supports of the copier frame 1. The outer guide wall of the groove 2 is omitted in the region of the image-forming station. Thus, as shown in FIG. 2, it is a simple matter to disengage the two links 16 and 23 of the chain 3 from one another, so that they can be pulled apart as shown, to afford ready access to the rollers 6 and 7 to permit removal of an old and spent carrier 5 and installation of a new one.

The manner in which the links of the chain 3 can be articulately connected, and in which the connection can be temporarily disengaged to permit the movement to the position of FIG. 2, is well known in the art of articulated chains and need not be described in detail. It will be understood, of course, that the rolls 6 and 7 are connected to the chain 3 in the manner described earlier with respect to FIG. 1, and thus travel with the same as the chain travels in the direction of the arrow A in its endless path.

FIGS. 3 and 4 show that the links of the chain 3 are provided with flanges 51 and 52 having lugs 53 and 54 on which the image carrier 5 is supported. The flanges 52 are provided with projecting pins 55 which support the flanges 51 and which move along the guide grooves 2 so that the chain 3 travels in the path dictated by the configuration of the grooves 2. Because of the spacing d (see FIG. 3) between the flanges 51 and the frame 1 of the copier, the gear 4 can engage with the pins 55 of the flanges 52 to drive the chain 3 in the direction of the arrow A.

Because of the differential curvatures of the guide path through the chain 3, it must be assured that the photoconductive carrier 5 is supported essentially at the level of the pivot axis of the individual links, i.e. at the level of the axis of the pins 55. If this were not assured, the supporting surfaces of adjacent lugs 53, 54 would move apart or be brought together in a scissor-like manner as they travel through differential curvatures and this would cause very high stresses to develop in different portions of the carrier 5, resulting in slippage of the carrier 5 and constant rubbing between the carrier 5 and the chain 3, leading to damage to the carrier 5.

It will be seen from the description hereinbefore that the disclosed invention meets the previously outlined objects and provides an improved electro-photographic copier avoiding the disadvantages of the prior art.

It will be understood that each of the elements described above, or two or more together, may also find a useful application in other types of applications differing from the types described above.

While the invention has been illustrated and described as embodied in an electo-photographic copier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electrophotographic copier, a combination comprising pay-out mezns for paying out a convoluted strip-shaped latent-image carrier; take-up means for taking up said carrier as the same is withdrawn from said pay-out means; an image-forming station for forming an image of an original to be copied on said image-carrier; and guide means for guiding said image carrier from said pay-out means to said take-up means in a path which includes at least adjacent said station a planar path portion wherein successive image-receiving increments of said image carrier travel past said station in substantially planar condition, said guide means comprising an articulated chain of support elements supporting said image carrier and having a width at least equal to the width of said image carrier, and guide elements laterally engaging and guiding said support elements.

2. A combination as defined in claim 1, wherein said chain of support elements is endless, and said pay-out and take-up means are located within the space surrounded by said endless chain.

3. A combination as defined in claim 2, wherein said chain travels along said path; and further comprising mounting means mounting said pay-out and take-up means on said chain for travel with the same.

4. A combination as defined in claim 2, said guide elements being located laterally adjacent said path and formed with grooves extending along the same, said chain having lateral portions engaging in and guided by said grooves.

5. A combination as defined in claim 4, wherein said chain is composed of successive, at least partly overlapping, articulated-together links.

6. A combination as defined in claim 4; and further comprising drive means for withdrawing increments of said image carrier from said pay-out means and effecting taking-up of the withdrawn image-carrier onto said take-up means.

7. A combination as defined in claim 6, wherein said drive means is connected to, and travels with, said chain.

8. A combination as defined in claim 6, wherein said drive means comprises a pawl and ratchet drive.

9. A combination as defined in claim 6; and further comprising advancing means for advancing said chain along said path.

* * * * *